US009752405B1

(12) United States Patent
Jennings et al.

(10) Patent No.: US 9,752,405 B1
(45) Date of Patent: Sep. 5, 2017

(54) SHEAR RAM TYPE BLOWOUT PREVENTER

(71) Applicant: Phyllis A. Jennings, Tomball, TX (US)

(72) Inventors: Charles Edward Jennings, Tomball, TX (US); J. Carter Miller, Jr., Tomball, TX (US)

(73) Assignee: Phyllis A. Jennings, Tomball, TX (US)

( * ) Notice: Subject to any disclaimer, the term of this patent is extended or adjusted under 35 U.S.C. 154(b) by 0 days.

(21) Appl. No.: 15/241,311

(22) Filed: Aug. 19, 2016

Related U.S. Application Data

(63) Continuation-in-part of application No. 14/571,774, filed on Dec. 16, 2014, now Pat. No. 9,593,550.

(60) Provisional application No. 61/964,436, filed on Jan. 6, 2014.

(51) Int. Cl.
*E21B 33/06* (2006.01)
*E21B 29/00* (2006.01)
*E21B 29/08* (2006.01)

(52) U.S. Cl.
CPC ..... *E21B 33/063* (2013.01); *E21B 29/08* (2013.01)

(58) Field of Classification Search
CPC ..... E21B 29/08; E21B 29/00; E21B 33/063; E21B 33/06
USPC ..... 166/297, 55, 55.2; 251/1.3
See application file for complete search history.

(56) References Cited

U.S. PATENT DOCUMENTS

| | | | | |
|---|---|---|---|---|
| 3,670,761 | A * | 6/1972 | Lerouax | E21B 33/062 137/315.02 |
| 6,244,560 | B1 * | 6/2001 | Johnson | E21B 33/062 251/1.3 |
| 6,969,042 | B2 * | 11/2005 | Gaydos | E21B 33/063 251/1.1 |
| 8,387,706 | B2 | 3/2013 | Baugh | |
| 8,443,880 | B1 | 5/2013 | Jahnke | |
| 8,449,815 | B2 | 5/2013 | Shimizu et al. | |
| 9,212,103 | B2 | 12/2015 | Coppedge et al. | |
| 9,593,550 | B1 * | 3/2017 | Jennings | E21B 33/063 |

* cited by examiner

*Primary Examiner* — Kenneth L Thompson
(74) *Attorney, Agent, or Firm* — Buskop Law Group, P.C.; Wendy Buskop

(57) ABSTRACT

An angle-cut shear ram blowout preventer system containing an angle-cut shear ram inside a ram housing with a ram housing bore. A ram cylinder pressure housing can be secured to the ram housing, wherein the ram cylinder pressure housing can be fluidly connected to a hydraulic pressure source or a pneumatic pressure source. A piston in the ram cylinder pressure housing can be fluidly connected to the hydraulic pressure source or the pneumatic pressure source. A taper can be extended from the ram housing bore into a through bore to simultaneously sever a pipe in a well and seal the well once the pipe is severed without requiring additional downhole tools.

21 Claims, 9 Drawing Sheets

SHEAR RAM TYPE BLOWOUT PREVENTER

CROSS REFERENCE TO RELATED APPLICATIONS

The current application is a Continuation in Part of U.S. patent application Ser. No. 14/571,774 filed on Dec. 16, 2014, now U.S. Pat. No. 9,593,550, entitled "SHEAR RAM TYPE BLOWOUT PREVENTER", which claims priority to and the benefit of U.S. Provisional Patent Application Ser. No. 61/964,436 filed on Jan. 6, 2014, entitled "Angle-cut shear-ram type blowout preventer," These references are herein incorporated in their entirety.

FIELD

The present embodiments generally relate to an improved blowout preventer and in more particularly a new type blowout preventer (BOP) having one or more angled-cut shear rams so that in the event of a well blowout with pipe in the hole, and the ram piston activated, the angled ram blade with hardened serrations passes across the pipe in the bore, cutting into the pipe at a specific angle with one long power stroke at the same time a second angle lifts up on the pipe causing the pipe to snap and break. This new method is referred to herein as "The Score and Break technique" rather than the old brute force blunt nose crush and mash method customary with conventional BOPs.

BACKGROUND

Having absolute pressure control of a hydrocarbon producing well during all drilling and completion operations is an absolute must. This is to protect personnel first and then the drilling rig and other expensive equipment. The main device in place for well pressure control during these operations is the blowout preventer (BOP). BOP's are designed either as ram, ram-shear or annular BOP'S and all are used to seal a wellbore in the event of a blowout. Drilling for hydrocarbons involves penetrating a variety of subsurface geological formations which are layers in the earth. Each layer comprises a specific geologic composition such as, shale, sandstone, limestone, etc. The layers may contain trapped fluids or gas at different formation pressures, and the formation pressures usually increase with increasing depth. The mud weight of the drilling fluid in the wellbore is made heavy enough with barite etc. to overcome the formation pressure. This is done by increasing the density of the drilling fluid in the wellbore or/and increasing pump pressure at the surface of the well.

There are occasions during drilling operations when a wellbore may penetrate a layer having a formation pressure substantially higher than the pressure maintained in the wellbore by the mud weight. When this occurs, the well is said to have taken what is called a kick. The pressure increase associated with the kick is generally produced by gas along with oil, and water or a combination of all of these, and of course the mud is also kicked back with the influx of formation fluids from within the wellbore. The high pressure kick propagates from a point of entry in the wellbore up-hole from a high pressure region below to a low pressure region above. If the kick is allowed to reach the surface, drilling fluid, well tools, and other drilling tools may be blown out of the wellbore. These blowouts often result in catastrophic destruction of the drilling equipment including the drilling rig and could cause substantial injury or death to rig personnel.

Because of the of the potential for blowouts, BOP's are either installed at the surface or on the sea floor in deep water drilling arrangements so that kicks may be adequately controlled and circulated out of the system. BOP's may be activated to effectively seal in a wellbore until measures can be taken to control the kick and as stated earlier there are several types of BOP's, the most common of which are annular blowout preventers.

Annular blowout preventers typically comprise annular bulk elastomer donut shaped seals that are forced radially inward to squeeze around the drill pipe and/or running tools to completely seal the wellbore. Another type of blowout preventer is the ram-type blowout preventer. Ram-type preventers comprise a body supporting at least two oppositely positioned cylinders on each side of the through bore with powerful pistons internally which actuate rams. The rams may be pipe rams or variable pipe rams which, when activated, move to engage and surround drill pipe and well tools to seal the wellbore. Shear rams which, when activated, move to engage and physically shear any drill pipe or well tools in the wellbore. The rams are located opposite of each other, and whether pipe rams or shear rams the rams are normally located against one another at the center of the wellbore. In some cases, ram blocks are used which will effectively shear both rigid and flexible materials that are located in the through bore of the BOP.

Prior art of a couple of pipe ram assemblies are disclosed. A common characteristic of these pipe ram and shear ram blowout preventers is that each individual ram assembly comprises a carrier or holder of some type and a ram block connected to the carrier for limited relative lateral movement. One advantage of the former kind of construction is that each ram assembly comprises a relatively movable carrier and ram block, and a seal may be installed between the carrier and ram block, and such seal may be compressively actuated by relative movement of the carrier and ram block. More specifically, the ram assemblies are moved inwardly.

If the blowout preventer is of the pipe ram type, which simply seals around the outer diameter of the drill pipe, it is fairly convenient to design the structure so that the thicknesses of the ram block and carrier, measured longitudinally with respect to the drill pipe, are generally equal. This is desirable because it maximizes the surface area over which the forces may be distributed.

BRIEF DESCRIPTION OF THE DRAWINGS

The detailed description will be better understood in conjunction with the accompanying drawings as follows.

Figure 1:
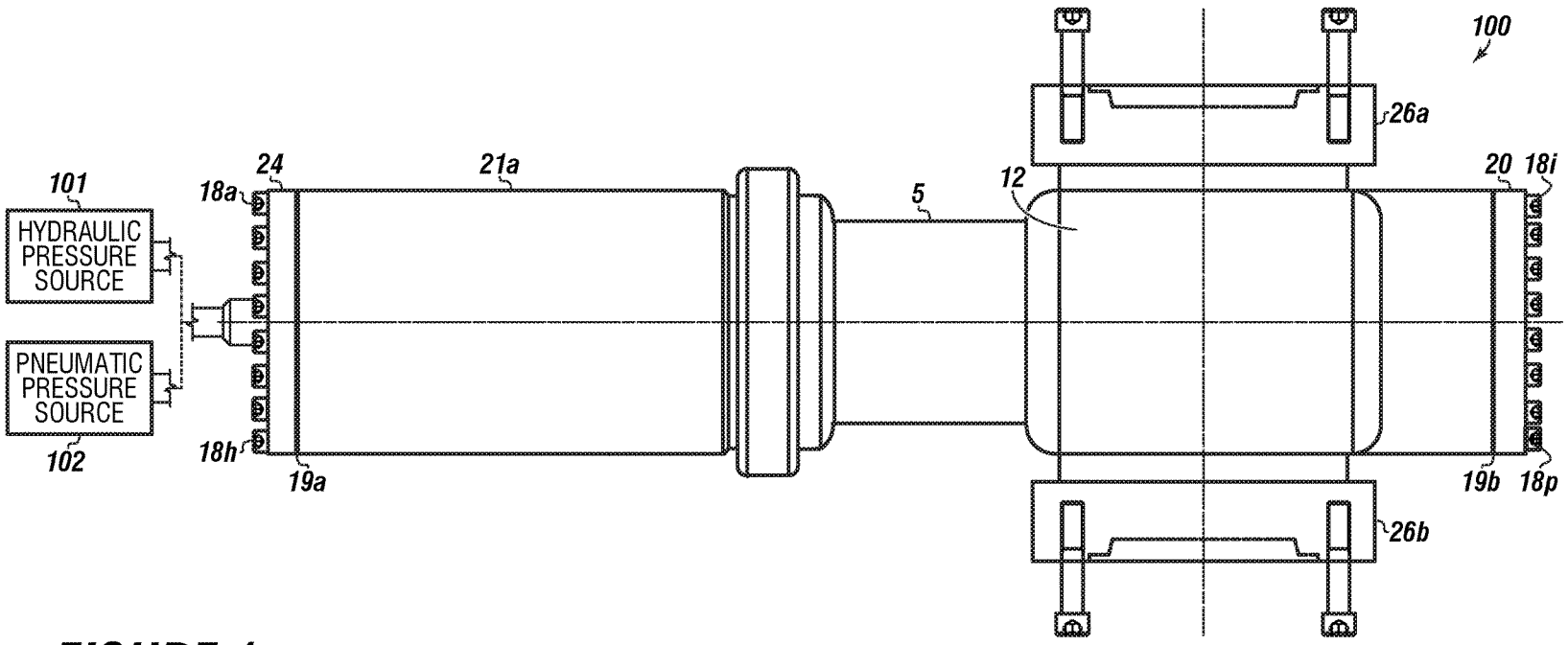
FIG. 1 depicts a side view of the angle-cut shear ram blowout preventer (BOP) system according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments pertain to novel, and new angle-cut shear ram type blowout preventers to be placed and run in the blowout preventer "BOP" stack for the purpose of shearing tubing, pipe, heavy wall drill pipe, heavy drill collars or running tools in the event of a blowout which could occur in many places in the formation of an oil or gas well while the heavy wall drill pipe and/or tools are still in the hole.

This novel BOP comprises a housing having a through vertical bore and can be adapted to be connected to and sealed to a wellhead, a riser or part of a lower marine riser package, placed in alignment with the wellbore. The ram or rams are movable within guide-ways on either side of the ram housing, across the through bore, moving from the fully retracted position where the front cutting edge of the ram can be fully withdrawn and the through bore can be fully open to the fully extended position where the cutting edge has moved across the through bore, cutting anything that might have been in the opening and sealing the through bore.

The angled-cut ram-blade can be made at 40 degrees across the leading cutting edge, to be longer on one side and shorter on the other, resembling a 40 degree triangle with the lead cutting edge tapered at the top away from the heavy wall drill pipe being cut so as to lift the weight of the heavy wall drill pipe while the heavy wall drill pipe is being cut, this is similar to pulling on a piece of steak, stretching it while cutting it with a serrated knife blade. The tapered ram blade can be also serrated with hardened teeth. The ram blade can be thick enough to seal and hold the full well pressure when blocking the through bore.

In this particular disclosure, there is only one angle-cut ram-blade with one powerful piston extending from one side of the BOP housing. When the piston is activated, the angle-cut ram moves across the through bore of the BOP. The angled and tapered leading edge of the angle-cut ram-blade forces the opposite side of the heavy wall drill pipe over against the side of the BOP's though bore, pressing against a hardened knife edge to retain the heavy wall drill pipe and helping to create a stress riser in the heavy wall drill pipe to be cut on the opposite side by the hardened serrated teeth of the ram.

The combined forces on both sides of the heavy wall drill pipe, plus the rip in the heavy wall drill pipe from the serrated teeth on the shear ram blade as it saws across the heavy wall drill pipe at an angle, along with the upward force caused by the taper on the leading edge of the rams simultaneously sever a pipe in a well and seal the well once the pipe is severed without requiring additional downhole tools.

The present embodiments will now be described more fully herein with reference to the illustrated embodiments set forth herein; rather these embodiments are provided so that this disclosure will be thorough and complete and will fully cover the scope of the invention to those skilled in the art. Like numbers refer to like elements through-out. Accompanying drawings in which embodiments of the invention are shown. This invention may, however, be embodied in many different forms and should not be construed as limited to the following.

The embodiments are designed to assist eliminate catastrophic mechanical equipment failure thus preventing death and dismemberment of rig personnel.

The embodiments are designed to prevent catastrophic mechanical equipment failure that would otherwise cause environmental contamination by containing biohazardous discharges.

The embodiments are designed to prevent catastrophic mechanical equipment failure thus preventing equipment blowout that can cause fires and explosions at a location.

In embodiments, an optional pyrotechnic accumulator can be used as a fail-safe option to support existing BOP safety measures.

The embodiments include an angle-cut shear ram blowout preventer (BOP) system to be used over a well when drilling for hydrocarbons through subterranean geological formations, during a blowout, the angle-cut shear ram blowout preventer (BOP) system can be configured to simultaneously sever a heavy wall drill pipe in the well and seal the well once the heavy wall drill pipe is severed without requiring additional downhole tools, the angle-cut shear ram blowout preventer (BOP) system can be installed on a blowout protector housing having a through bore, the through bore containing the heavy wall drill pipe, the heavy wall drill pipe extending between the well and a surface.

The angle-cut shear ram blowout preventer (BOP) system can have a ram housing with a ram housing bore.

The ram housing can be secured to the blowout protector housing. The ram housing bore intersects with a through bore.

In embodiments, a first ram cylinder pressure housing can be secured to the ram housing.

A first piston can be contained in the first ram cylinder pressure housing connected to a common rod longitudinally disposed in the first ram cylinder pressure housing. The first piston can be aligned with the ram housing bore.

A second ram cylinder pressure housing can be secured to the first ram cylinder pressure housing. The second ram cylinder pressure housing can be fluidly connected to the first ram cylinder pressure housing.

A second piston can be contained in the second ram cylinder pressure housing.

The second piston can be longitudinally connected to the common rod. The second piston can be fluidly connected to the hydraulic pressure source or the pneumatic pressure source. The common rod can be removable and can be disposed, at least partially, within each ram cylinder pressure housing. The common rod can be movable from a retracted position to an extended position in each ram housing bore.

At least one non-rotating rod can be disposed in the ram cylinder pressure housing.

An angle-cut shear ram can be connected to the common rod.

In embodiments, the angle-cut shear ram can have a body engaging the common rod and a taper with a cutting edge formed on the body opposite the common rod.

The angle-cut shear ram can be adapted to extend the taper from the ram housing bore into the through bore to sever heavy wall drill pipe as pressure is applied to the pistons from the hydraulic pressure source or the pneumatic pressure source, and extend at least a portion of the body into the through bore creating a through bore seal in the through bore with at least a portion of the body after the heavy wall drill pipe is severed by the taper.

Turning now to the Figures, FIG. 1 depicts a side view of the angle-cut shear ram blowout preventer (BOP) system according to one or more embodiments.

The angle-cut shear ram blowout preventer (BOP) system 100 can be used over a well when drilling for hydrocarbons through subterranean geological formations, during a blowout in order to simultaneously (i) sever a heavy wall drill pipe in a well and (ii) seal the well once the heavy wall drill pipe is severed without requiring additional downhole tools.

The angle-cut shear ram blowout preventer (BOP) system 100 can be attached to the blowout protector housing 12.

Each angle-cut shear ram blowout preventer (BOP) system 100 can have a ram housing 5.

In embodiments, a first ram cylinder pressure housing 21*a* can be secured to the ram housing 5. The first ram cylinder pressure housing 21*a* can be fluidly connected to a hydraulic pressure source 101 or a pneumatic pressure source 102.

A pressure containing end cap 24 can be on one end of the first ram cylinder pressure housing 21*a*. The pressure containing end cap 24 can be mounted, enabling easy access, maintenance and repair of the system.

In embodiments, an access flange 20 can be secured to the ram housing 5 enabling easy access, maintenance and repair of the system. Studded flanges 18*a*-18*h* can secure the pressure containing end cap 24. In embodiments, studded flanges 18*i* and 18*p* can secure the access flange 20. Gaskets 19*a* and 19*b* can be used with the pressure containing end cap and access flanges respectively. Additional gaskets can be used on the top and the bottom of blowout protector housing 12 for bolting in and sealing to the wellhead, riser and/or lower marine riser package.

The angle-cut shear ram blowout preventer (BOP) system 100 can include at least one clamp 26*a* and 26*b* for engaging above and below the blowout protector housing 12, connecting, locking, and sealing the angle-cut shear ram blowout preventer (BOP) system 100 to the blowout protector housing 12.

Figure 2:
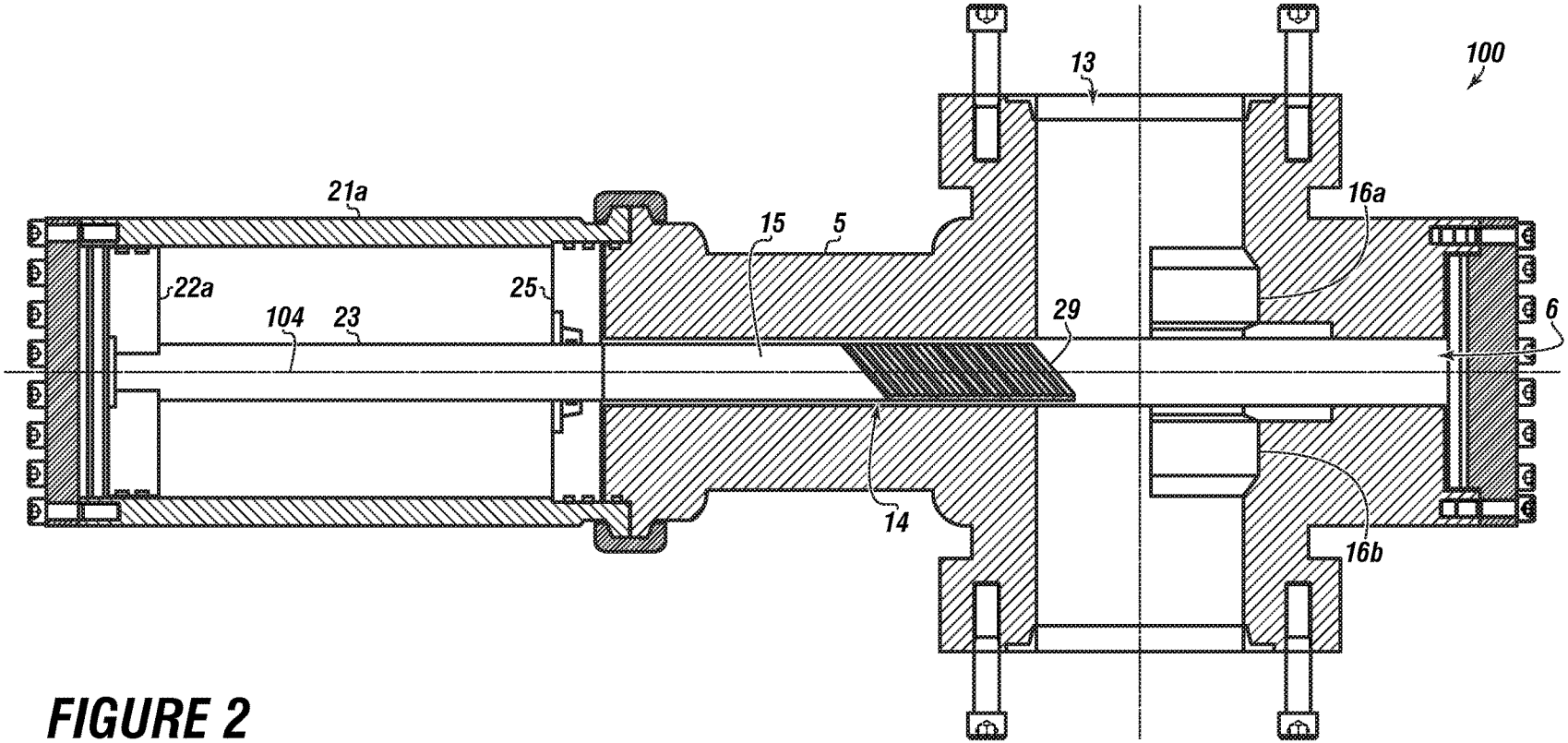
FIG. 2 depicts a cross section of the angle-cut shear ram blowout preventer (BOP) system according to one or more embodiments.

FIG. 2 depicts a cross section of the angle-cut shear ram blowout preventer (BOP) system according to one or more embodiments.

The angle-cut shear ram blowout preventer (BOP) system 100 can have a ram housing 5 with a ram housing bore 6. A first piston 22*a* can be aligned with the ram housing bore 6. A center axis 104 for the ram housing bore 6 is shown.

The hydraulic pressure source or the pneumatic pressure source can be fluidly connected to and power the first piston 22*a* in the first ram cylinder pressure housing 21*a*. The psi can be very low to power the first piston 22*a*; however, the psi must be enough to shear the heavy wall drill pipe. The psi used can be affected by the wall thickness of the heavy wall drill pipe, whether or not the heavy wall drill pipe is heat treated, such as a psi from 500 psi to 10,000 psi.

In embodiments, the ram housing 5 can have an angle-cut shear ram 14, which can be connected to a common rod 23. The angle-cut shear ram 14 can have two portions, namely a body 15 engaging the common rod 23 and a taper 29 formed on the body 15 opposite the common rod 23. The angle-cut shear ram 14 is shown in a retracted position.

The angle-cut shear ram 14 can be adapted to extend the taper 29 from the ram housing bore 6 into a through bore 13 to sever the heavy wall drill pipe as pressure is applied to the first piston 22*a* from the pneumatic pressure source or the hydraulic pressure source. As the pressure extends at least a portion of the body 15 into the through bore 13, the body 15 of the angle-cut shear ram 14 creates a through bore seal in the through bore 13 after the heavy wall drill pipe is severed.

In embodiments, as the angle-cut shear ram 14 severs the heavy wall drill pipe and then extends the taper 29 from the ram housing bore 6 as pressure is applied, causing each length of stroke of the first piston 22*a* to increase in length by a distance from 1 percent to 300 percent of a diameter of the through bore 13.

The angle-cut shear ram blowout preventer (BOP) system can include a pressure divider 25 with a seal and bearing assembly for the common rod 23.

The common rod 23 can be connected to the first piston 22*a*. The common rod 23 can be movable from a retracted position at least partially within the first ram cylinder pressure housing 21*a* into the ram housing bore 6 of the ram housing 5.

The ram housing bore 6 can be secured to the blowout protector housing and can intersect with the through bore 13, such as at a 90 degree angle. The angle-cut shear ram blowout preventer (BOP) system 100 can fluidly communicate with the through bore 13.

Hardened shear reaction inserts 16*a* and 16*b* can be mounted in relief recesses to engage the heavy wall drill pipe. It should be understood that as the angle-cut shear ram 14 applies load to the heavy wall drill pipe, the taper 29 also applies a lifting force to the heavy wall drill pipe at a 90 degree angle to the load from the angle-cut shear ram 14 while the hardened shear reaction inserts 16*a* and 16*b* hold the heavy wall drill pipe down.

Figure 3:
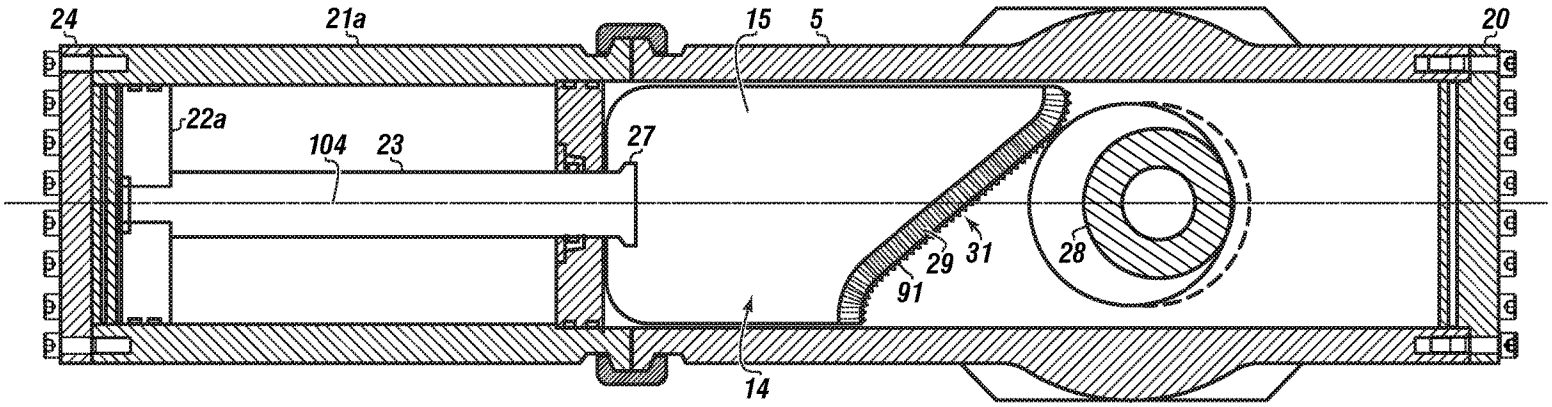
FIG. 3 depicts a cross section of the angle-cut shear ram prior to engagement with a pipe in the angle-cut shear ram blowout preventer (BOP) system according to one or more embodiments.

FIG. 3 depicts a cross section of the angle-cut shear ram prior to engagement with a pipe in the angle-cut shear ram blowout preventer (BOP) system according to one or more embodiments.

The ram housing 5 can be connected to the first ram cylinder pressure housing 21*a*. The first ram cylinder pressure housing 21*a* can contain the first piston 22*a* and the angle-cut shear ram 14 in the retracted position. A cutting edge 31 of the angle-cut shear ram 14 can be at an angle on the taper 29, such as at a forty degree angle. A heavy wall drill pipe 28 is shown in the through bore.

The common rod 23 of the first piston 22*a* can extend and retract along the center axis 104 of the angle-cut shear ram 14.

The angle-cut shear ram blowout preventer (BOP) system can have a tang 27 connecting the common rod 23 to the body 15. The angle-cut shear ram blowout preventer (BOP) system can have hardened serrated teeth 91 disposed on the cutting edge 31. The hardened serrated teeth 91 can simultaneously (i) create a stress score mark while (ii) applying a lifting force for parting the heavy wall drill pipe 28 without deforming the hardened serrated teeth 91. The lifting force can range from 1,000 psi to 500,000 psi. The lifting force in embodiments can raise the heavy wall drill pipe 28 from 0.125 of an inch to 3 inches.

The access flange 20 is can be secured to the ram housing 5, and the pressure containing end cap 24 can be mounted to the first ram cylinder pressure housing 21 enabling easy access, maintenance and repair of the angle-cut shear ream blowout preventer (BOP) system.

In embodiments, as the cutting edge 31 contacts the heavy wall drill pipe 28 at an angle, such as a 40 degree angle, from the center axis 104 in the horizontal plane and angles back at 40 degrees or less from the center axis 104 in the vertical plane, the cutting edge of the taper 29 saws across the heavy wall drill pipe 28 at 40 degrees or less while simultaneously lifting the heavy wall drill pipe 28 at 40 degrees or more.

Figure 4:
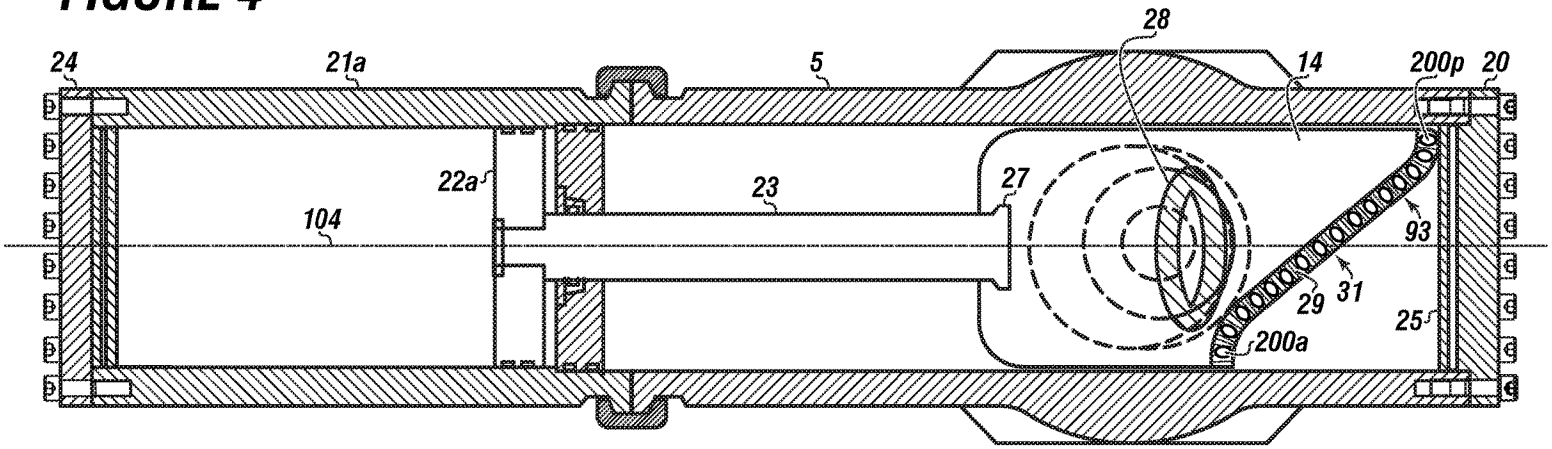
FIG. 4 depicts a cross section of the angle-cut shear ram fully extending creating a seal in the through bore according to one or more embodiments.

FIG. 4 depicts a cross section of the angle-cut shear ram fully extending creating a seal in the through bore according to one or more embodiments.

In embodiments, the first piston 22*a* and the angle-cut shear ram 14 can be in an extended position along the center axis 104. The heavy wall drill pipe 28 in the through bore can be in a parted configuration, that is, the heavy wall drill pipe 28 can be successfully severed by the angle-cut shear ram 14.

The ram housing 5 containing the common rod 23 of the first piston 22*a* can be connected to the angle-cut shear ram 14 by the tang 27, which can be similar to the way a gate valve can be connected to a valve stem.

The pressure divider 25 can be mounted between the through bore and the ram housing 5. In embodiments, the pressure divider 25 can be mounted inside the first ram cylinder pressure housing 21*a* without fasteners.

Multiple high strength carbide cutting nodes 200*a*-200*p* can be installed on the cutting edge 31 of the taper 29. The multiple high strength carbide cutting nodes 200*a*-200*p* can be disposed on the taper 29. In embodiments, a tungsten carbide hardened edge 93 can be disposed on the taper 29.

The multiple high strength carbide cutting nodes 200*a*-200*p* can be of at least one of:

a tungsten carbide insert, a synthetic diamond cutting material, a diamond enhanced cutting material, a diamond impregnated metal matrix, and combinations thereof.

In embodiments, if a diamond enhanced cutter material can be used, the inserts can be at least two rows of diamond cutter material on the cutting edge 31.

The multiple high strength carbide cutting nodes 200*a*-200*p* can be flat faced, dome shaped, or combinations thereof. The poly-diamond cutter material and the multiple high strength carbide cutting nodes 200*a*-200*p* can have various shapes such as circular, elliptical, angular, or combinations thereof.

In embodiments, the tungsten carbide hardened edge 93 can be disposed on the cutting edge 31. In embodiments, the tungsten carbide hardened edge 93 can be a crushed tungsten carbide in a nickel bronze matrix. In embodiments, the tungsten carbide hardened edge 93 can be a plurality of separated tungsten carbide cutting segments formed in polygonal shapes.

The cutting materials, such as poly-diamond cutter nodes, can be grouped in circles, organized in swirl patterns, or in another pattern.

In embodiments, the density of the poly-diamond cutter nodes can range from 0.125 inches to 2 inches. The poly-diamond cutter nodes can be aligned in rows of two poly-diamond cutter nodes to sixteen poly-diamond cutter nodes. In other embodiments, the poly-diamond cutter nodes can be aligned in rows, such as several nodes in rows of three.

In embodiments, the poly-diamond cutter nodes can be made from synthetic diamond material made by US Synthetic of Orem, Utah. The poly-diamond cutter nodes can be flat faced, dome shaped, or combinations thereof. The poly-diamond cutter nodes can have a shape that is elliptical, circular, angular, or combinations thereof. The height of each poly-diamond cutter node as measured from the surface of one of the spiraled angled sections can range from flush flat to about ¾ of an inch.

The multiple high strength carbide cutting nodes 200*a*-200*p* can be formed on the spiral angled section, either as a single row, double rows, triple rows, multiple rows, or in patches. The multiple high strength carbide cutting nodes 200*a*-200*p* are known as "carbide inserts" in the industry. Usable high strength carbide cutting nodes can be round, elliptical, or angular. Usable high strength carbide cutting nodes can be flat faced or round faced.

The access flange 20 can be secured to the ram housing 5, and the pressure containing end cap 24 can be mounted to the first ram cylinder pressure housing 21*a* enabling easy access, maintenance and repair of the angle-cut shear ram blowout preventer (BOP) system.

In embodiments, the cutting edge 31 of the angle-cut shear ram 14 can travel at a 90 degree angle across the through bore engaging the heavy wall drill pipe 28 at an angle offset from a center axis 104 of the angle-cut shear ram 14.

In embodiments, the angle-cut shear ram 14 can travel at a 90 degree angle across the through bore engaging the heavy wall drill pipe at an angle offset from 2 degrees to 40 degrees from the center axis 104 of the angle-cut shear ram 14.

Figure 5:
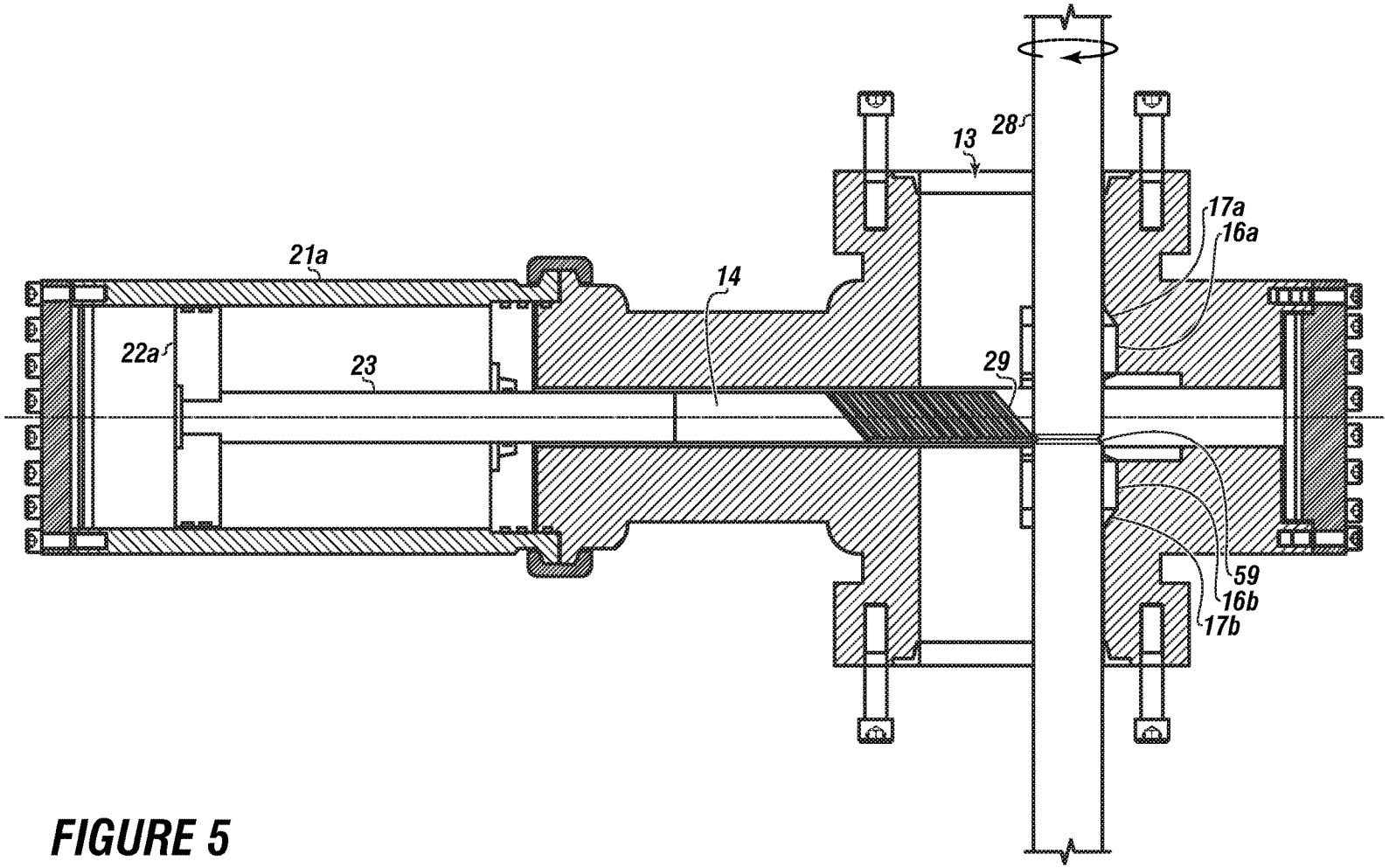
FIG. 5 depicts a cross section of the angle-cut shear ram creating a stress score mark on the heavy wall drill pipe according to one or more embodiments.

FIG. 5 depicts a cross section of the angle-cut shear ram creating a stress score mark on the heavy wall drill pipe according to one or more embodiments.

In embodiments, a section of the heavy wall drill pipe 28 can be a drill collar. The heavy wall drill pipe 28 can be in the through bore 13 of the blowout protector housing. The first piston 22*a* with the common rod 23*a* in the first ram cylinder pressure housing 21*a* can drive the angle-cut shear ram 14 into the heavy wall drill pipe 28 against the side of the through bore 13 and against the hardened shear reaction inserts 16*a* and 16*b* located in relief recesses 17*a* and 17*b*.

As the angle-cut shear ram 14 applies load to the heavy wall drill pipe 28, the taper 29 can also apply a lifting force to the heavy wall drill pipe 28 at a 90 degree angle to the load from the angle-cut shear ram 14 while the hardened shear reaction inserts 16*a* and 16*b* hold the heavy wall drill pipe 28 down. This pulling apart action plus the sawing action of the cutting edge of angle-cut shear ram 14 can cause the heavy wall drill pipe 28 to part.

The hardened shear reaction inserts 16*a* and 16*b* can grip and hold one side of the heavy wall drill pipe 28 while the other side of the heavy wall drill pipe 28 is being cut and lifted by the taper 29.

A stress score mark 59 can be formed circumferentially on the heavy wall drill pipe by the cutting edge as pressure is applied to the first piston 22*a*.

Figure 6:
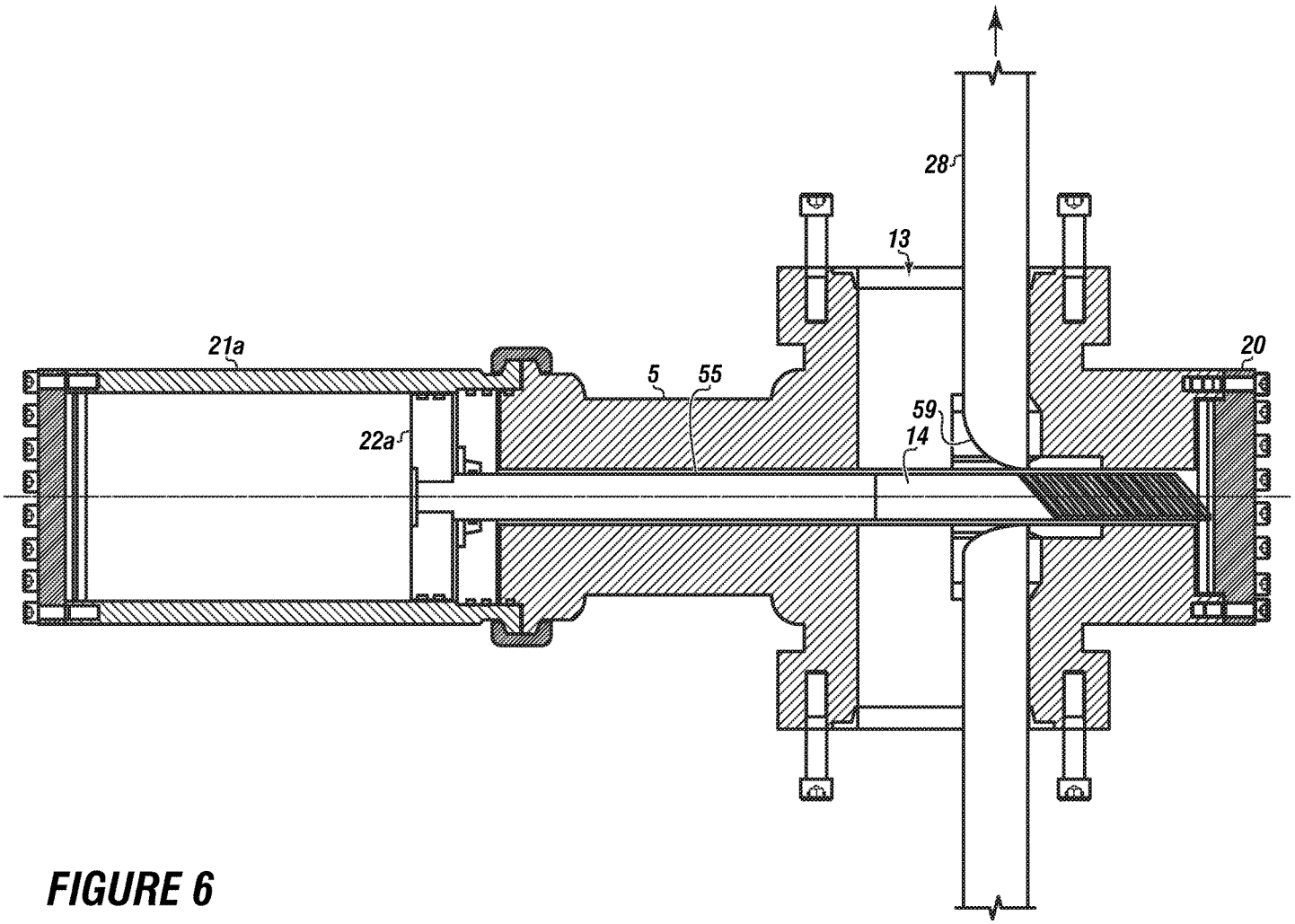
FIG. 6 depicts a cross section of the angle-cut shear ram after cutting and lifting the heavy wall drill pipe in the through bore according to one or more embodiments.

FIG. 6 depicts a cross section of the angle-cut shear ram after cutting and lifting the heavy wall drill pipe in the through bore according to one or more embodiments.

The first ram cylinder pressure housing 21*a* with the first piston 22*a* is shown pushing against the angle-cut shear ram 14 in the ram housing 5.

The angle-cut shear ram 14 is shown fully engaged across the through bore 13 of blowout protector housing and connected against the access flange 20 with the heavy wall drill pipe 28 fully parted.

The upper part of the heavy wall drill pipe 28 is lifted and can be resting on top of the angle-cut shear ram 14. The angle-cut shear ram 14 can form a metal seal across the through bore 13 of the blowout protector housing.

In embodiments as the angle-cut shear ram blowout preventer (BOP) system can move the angle-cut shear ram 14 from a retracted position in the ram housing bore into the through bore 13, the angle-cut shear ram 14 can exert a load on the heavy wall drill pipe 28 in the through bore 13 rotating the heavy wall drill pipe 28 in the through bore 13 while simultaneously applying: (i) a circumferential sawing action on the heavy wall drill pipe creating the stress score mark 59 on the heavy wall drill pipe 28 while the heavy wall drill pipe 28 rotates in the through bore 13. The angle-cut shear ram 14 can simultaneously with the circumferential sawing action apply (ii) a lifting force at the formed stress score mark 59 causing the heavy wall drill pipe 28 to separate.

In embodiments, the angle-cut shear ram blowout preventer (BOP) system can have a sliding ram track 55 mounted in the ram housing bore engaging the taper as the taper moves from a retracted location in the ram housing bore into the through bore 13. In embodiments, two rails can be used in parallel to align the angle-cut shear ram. In other embodiments, the sliding ram track 55 can be integral in the ram housing bore.

Figure 7:
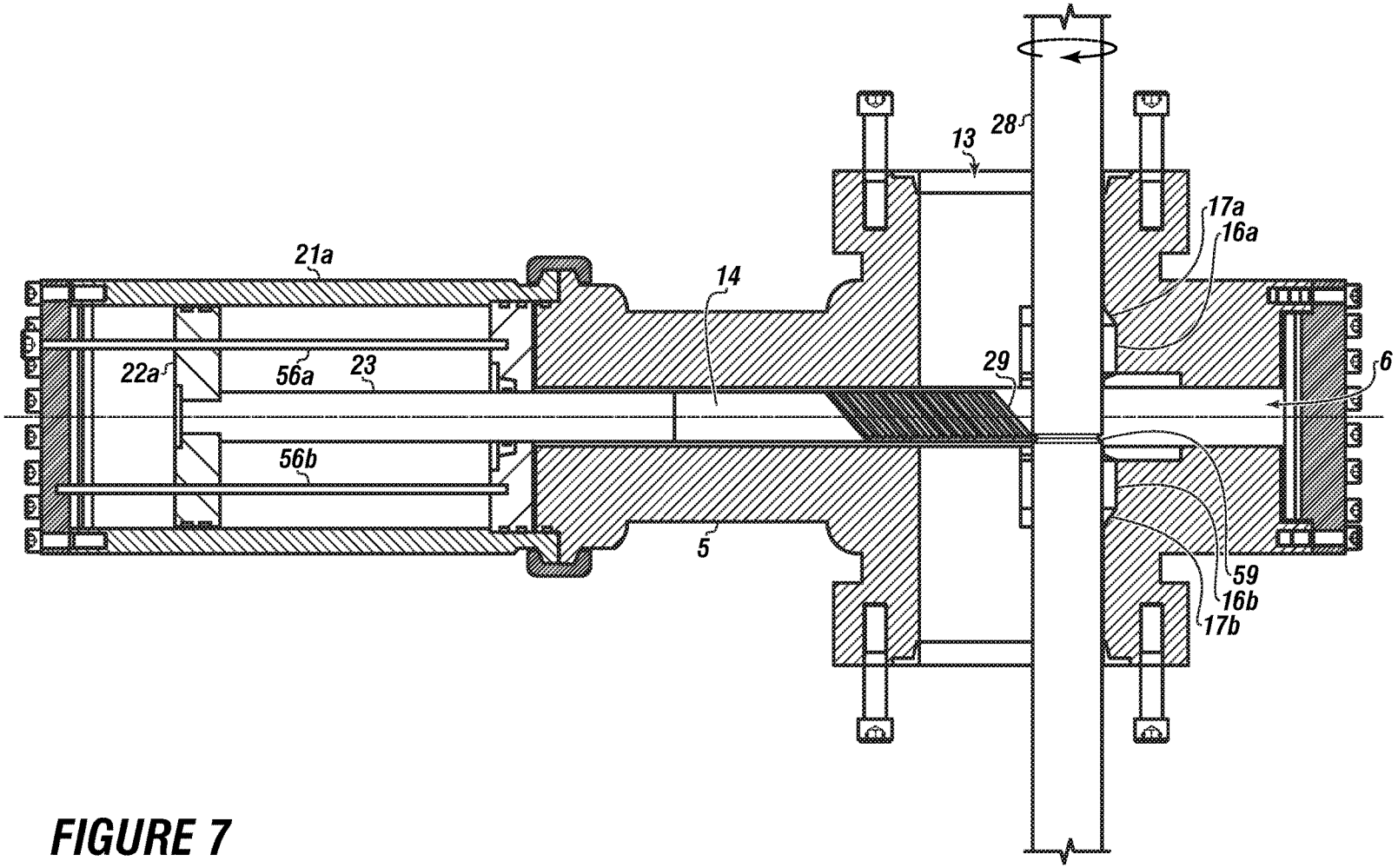
FIG. 7 depicts an embodiment of the angle-cut shear ram with two non-rotating rods according to one or more embodiments.

FIG. 7 depicts an embodiment of the angle-cut shear ram with two non-rotating rods according to one or more embodiments.

The ram housing 5 can be connected to first ram cylinder pressure housing 21*a* with an external non rotating rod 56*a* and an internal non rotating rod 56*b* extending through the first ram cylinder pressure housing 21*a* on either side of the common rod 23. The non-rotating rods can be in parallel to the center axis. Each non-rotating rod can have different diameters from each other. The diameters of the non-rotating rods are dependent on a given bore and pressure of the system. For example, a pair of non-rotating rods can range in size from 1 inch to 8 inches. In embodiments, the non-rotating rods can be formed from steel, such as high strength steel.

Hardened shear reaction inserts 16*a* and 16*b* can be mounted in relief recesses 17*a* and 17*b* to engage the heavy wall drill pipe 28. It should be understood that as the angle-cut shear ram 14 in the ram housing bore 6 applies load to the heavy wall drill pipe 28 in the through bore 13, the taper 29 also applies a lifting force to the heavy wall drill pipe 28 at a 90 degree angle to the load from the angle-cut shear ram 14 while the hardened shear reaction inserts 16*a* and 16*b* hold the heavy wall drill pipe down.

The stress score mark 59 can be formed circumferentially on the heavy wall drill pipe 28 by the cutting edge as pressure is applied to the first piston 22*a*.

Figure 8:
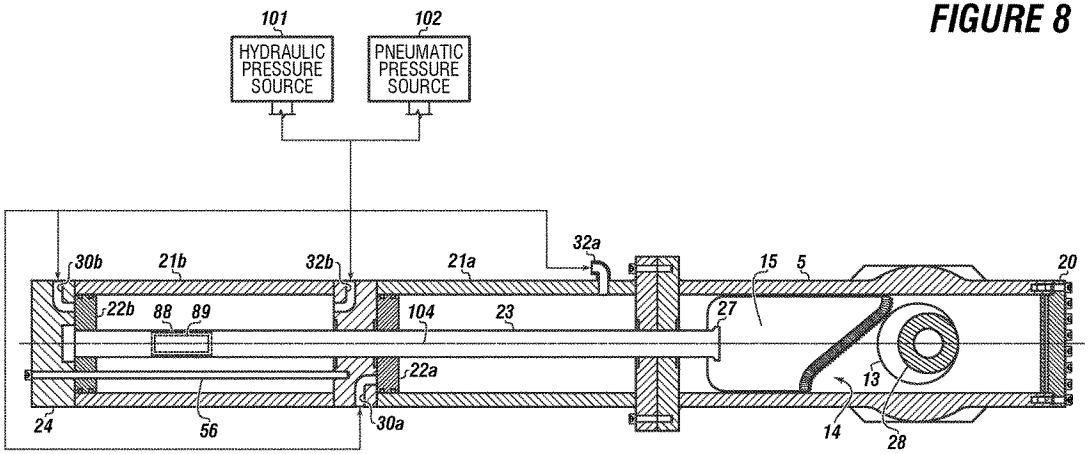
FIG. 8 depicts an embodiment of the angle-cut shear ram with two ram cylinder pressure housings connected together using a common rod according to one or more embodiments.

FIG. 8 depicts an embodiment of the angle-cut shear ram with two ram cylinder pressure housings connected together using a common rod according to one or more embodiments.

In embodiments, the ram housing 5 can be secured to the blowout protector housing.

In embodiments, an access flange 20 can be secured to the ram housing 5.

The first ram cylinder pressure housing 21*a* can be secured to the ram housing 5, wherein the first piston 22*a* in the first ram cylinder pressure housing 21*a* can be connected to the common rod 23, which can be longitudinally disposed in the first ram cylinder pressure housing 21*a*. The first piston 22*a* can be aligned with the ram housing bore, wherein the ram housing bore can have the center axis 104.

A second ram cylinder pressure housing 21*b* can be secured to the first ram cylinder pressure housing 21*a*, wherein the second ram cylinder pressure housing can be fluidly connected to the first ram cylinder pressure housing.

In embodiments, a non-rotating rod 56 can extend through the second ram cylinder pressure housing 21*b*.

A pressure containing end cap 24 can be mounted to the second ram cylinder pressure housing 21*b*.

In embodiments, a second piston 22*b* can be mounted in the second ram cylinder pressure housing 21*b*. The second piston 22*b* can be longitudinally connected to the common rod 23.

The second piston can be fluidly connected to the hydraulic pressure source 101 or the pneumatic pressure source 102.

A hydraulic pressure source 101, a pneumatic pressure source 102 or combinations thereof can be used to move the first piston 22*a* and the second piston 22*b* via extend ports 30*a* and 30*b* or retract ports 32*a* and 32*b*.

The common rod 23 can be disposed, at least partially, within each ram cylinder pressure housing 21*a* and 21*b*, the common rod 23 can be movable from a retracted position to an extended position in the ram housing bore.

The tang 27 can be used for connecting the common rod 23 to the body 15.

In embodiments, the angle-cut shear ram 14 can be connected to the common rod 23.

A hollow bore 88 can be formed in the common rod 23. In embodiments, a linear displacement transducer 89 can be disposed in the hollow bore 88 enabling remote control of the common rod 23.

In embodiments, the heavy wall drill pipe 28 can be in the through bore 13. The heavy wall drill pipe 28 can extend between a well and a surface. The well can flow hydrocarbons or drilling fluids from the well to the surface.

In embodiments, wherein the second ram cylinder pressure housing 21*b* is connected or mounted to the first ram cylinder pressure housing 21*a*, the pressure containing end cap 24 can be mounted to the second ram cylinder pressure housing 21*b* without mounting to the first ram cylinder pressure housing.

Figure 9:
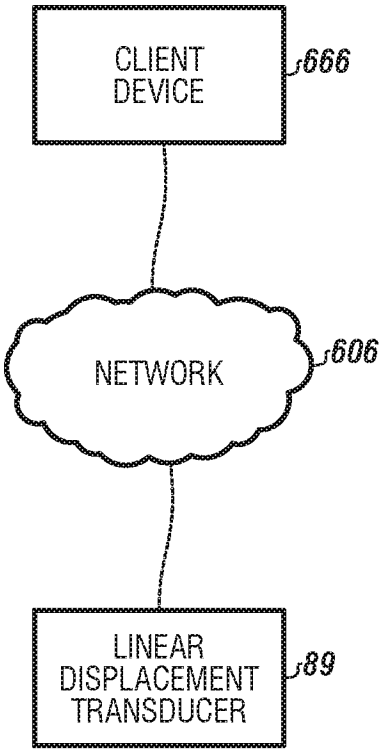
FIG. 9 depicts a remote monitoring system according to one or more embodiments.

FIG. 9 depicts a remote monitoring system according to one or more embodiments.

A network 606 can be connected the linear displacement transducer 89 for communicating with a client device 666.

The client device can be any known client device in the industry, such as a computer, a laptop, a tablet computer, a mobile or cellular phone, or any device that is capable of bidirectional communication.

Figure 10:
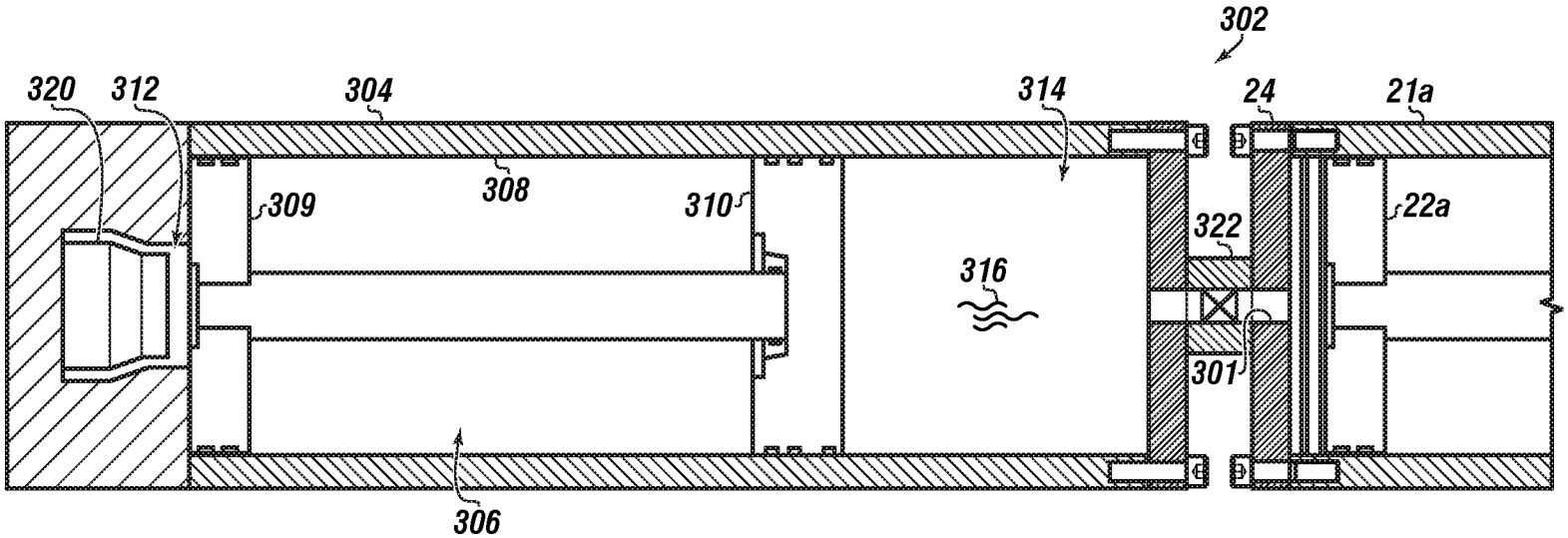
FIG. 10 presents a pyrotechnic accumulator usable with one or more embodiments.

FIG. 10 presents a pyrotechnic accumulator usable with one or more embodiments.

A pyrotechnic accumulator 302 can be mounted to the pressure containing end cap 24 with a gas inlet port 301. The pressure containing end cap 24 can be mounted to the first ram cylinder pressure housing 21*a*, which can have the first piston 22*a*.

In embodiments, the gas inlet port 301 can be formed through the pressure containing end cap 24, and the pyrotechnic accumulator 302 can be fluidly connected to the gas inlet port 301 and fixedly mounted to the pressure containing end cap 24.

The pyrotechnic accumulator 302 can have a tubular body 304 affixed to and extending axially from the pressure containing end cap 24 in fluid communication with the gas inlet port 301. The pyrotechnic accumulator 302 can operate similar to those manufactured by Bastion Technologies, Inc., of Houston, Tex.

In embodiments, the tubular body 304 can contain a piston 306 movably disposed in a bore 308. The piston 306 can have an ignition end 309 and a pressurization end 310.

A propellant chamber 312 can be formed on the ignition end 309 of the piston 306 opposite the pressurization end 310.

A pressurized fluid chamber 314 can be located on the pressurization end 310 of the piston 306 for supplying pressurized fluid 316 into the gas inlet port 301 of the pressure containing end cap 24.

The pressurized fluid 316 can be exhausted under pressure into the gas inlet port 301 in response to ignition of a propellant charge 320 contained in the propellant chamber. The pressurized fluid can have a pressure ranging from 5000 psi to 10000 psi.

A one-way flow control device 322 can be connected to the pressure containing end cap 24 permitting one-way flow from the pressurized fluid chamber 314 to the shear ram blowout preventer (BOP) system to enable on/off operation of the pyrotechnic accumulator 302 into the shear ram type blowout preventer (BOP) system.

The pyrotechnic accumulator provides a fail/safe mechanism to prevent offshore drilling rig explosion incidents from happening.

While these embodiments have been described with emphasis on the embodiments, it should be understood that within the scope of the appended claims, the embodiments might be practiced other than as specifically described herein.

What is claimed is:

1. An angle-cut shear ram blowout preventer system to be used over a well when drilling for hydrocarbons through subterranean geological formations, during a blowout, the angle-cut shear ram blowout preventer system is configured to simultaneously sever a heavy wall drill pipe in the well and seal the well once the heavy wall drill pipe is severed without requiring additional downhole tools, the angle-cut shear ram blowout preventer system is installed on a blowout protector housing having a through bore, the through bore containing the heavy wall drill pipe, the heavy wall drill pipe extending between the well and a surface, the angle-cut shear ram blowout preventer system comprising:

a. a ram housing with a ram housing bore, wherein the ram housing is secured to the blowout protector housing, and wherein the ram housing bore intersects with the through bore;

b. a first ram cylinder pressure housing secured to the ram housing;

c. a first piston in the first ram cylinder pressure housing connected to a common rod longitudinally disposed in the first ram cylinder pressure housing, wherein the first piston is aligned with the ram housing bore;

d. a second ram cylinder pressure housing secured to the first ram cylinder pressure housing, wherein the second ram cylinder pressure housing is fluidly connected to the first ram cylinder pressure housing;

e. a second piston in the second ram cylinder pressure housing, wherein the second piston is longitudinally connected to the common rod;

wherein the first piston, the second piston or both the first piston and the second piston are fluidly connected to a hydraulic pressure source or a pneumatic pressure source, and wherein the common rod is disposed, at least partially within the first ram cylinder pressure housing, the second ram cylinder pressure housing or both the first ram cylinder pressure housing and the second ram cylinder pressure housing, the common rod moveable from a retracted position to an extended position in the ram housing bore;

f. at least one non-rotating rod disposed in the first ram cylinder pressure housing, the second ram cylinder pressure housing or both the first ram cylinder pressure housing and the second ram cylinder pressure housing; and g. an angle-cut shear ram connected to the common rod, wherein the angle-cut shear ram comprises:

(i) a body engaging the common rod; and (ii) a taper with a cutting edge formed on the body opposite the common rod; and wherein the angle-cut shear ram is adapted to extend the taper from the ram housing bore into the through bore to sever the heavy wall drill pipe as pressure is applied to the first piston and the second piston from the hydraulic pressure source or the pneumatic pressure source, and extend at least a portion of the body into the through bore creating a through bore seal in the through bore with at least the portion of the body after the heavy wall drill pipe is severed by the taper.

2. The angle-cut shear ram blowout preventer system of claim 1, wherein the angle-cut shear ram is configured to move from a retracted position in the ram housing bore through the through bore exerting a load on the heavy wall drill pipe in the through bore rotating the heavy wall drill pipe in the through bore while simultaneously applying: (i) a circumferential sawing action on the heavy wall drill pipe creating a stress score mark on the heavy wall drill pipe while the heavy wall drill pipe rotates in the through bore, and (ii) a lifting force at the formed stress score mark causing the heavy wall drill pipe to separate.

3. The angle-cut shear ram blowout preventer system of claim 2, further comprising hardened serrated teeth disposed on the cutting edge, wherein the hardened serrated teeth simultaneously create the stress score mark and apply the lifting force for parting the heavy wall drill pipe without deforming.

4. The angle-cut shear ram blowout preventer system of claim 3, wherein the cutting edge of the angle-cut shear ram travels at a 90 degree angle across the through bore engaging the heavy wall drill pipe at an angle offset from a center axis of the angle-cut shear ram.

5. The angle-cut shear ram blowout preventer system of claim 4, wherein the angle-cut shear ram travels at a 90 degree angle across the through bore engaging the heavy wall drill pipe at an angle offset from 2 degrees to 40 degrees from the center axis of the angle-cut shear ram.

6. The angle-cut shear ram blowout preventer system of claim 4, wherein as the cutting edge engages the heavy wall drill pipe at 40 degrees from the center axis in a horizontal plane and angles back at 40 degrees or less from the center axis in a vertical plane, the cutting edge of the taper saws across the heavy wall drill pipe at 40 degrees or less while simultaneously lifting the heavy wall drill pipe at 40 degrees or more.

7. The angle-cut shear ram blowout preventer system of claim 4, wherein as the angle-cut shear ram severs the heavy wall drill pipe and then extends the taper from the ram housing bore as the pressure is applied, causing each length of stroke of the piston to increase in length by a distance from 1 percent to 300 percent of a diameter of the through bore.

8. The angle-cut shear ram blowout preventer system of claim 6, further comprising a plurality of hardened shear reaction inserts to grip and hold one side of the heavy wall drill pipe while an opposite side of the heavy wall drill pipe is being cut and lifted by the taper.

9. The angle-cut shear ram blowout preventer system of claim 8, further comprising a clamp for engaging above and below the blowout protector housing connecting, locking, and sealing the angle-cut shear ram blowout preventer system to the blowout protector housing.

10. The angle-cut shear ram blowout preventer system of claim 1, further comprising a tang for connecting the common rod to the body.

11. The angle-cut shear ram blowout preventer system of claim 1, further comprising an access flange secured to the ram housing enabling easy access, maintenance, and repair of the angle-cut shear ram blowout preventer system, and a pressure containing end cap mounted to the ram cylinder pressure housing enabling easy access, maintenance, and repair of the angle-cut shear ram blowout preventer system.

12. The angle-cut shear ram blowout preventer system of claim 1, further comprising a pressure divider mounted between the through bore and the ram housing.

13. The angle-cut shear ram blowout preventer system of claim 12, wherein the pressure divider is mounted inside the ram cylinder pressure housing without fasteners.

14. The angle-cut shear ram blowout preventer system of claim 1, further comprising a sliding ram track mounted in the ram housing bore engaging the taper as the taper moves from a retracted location in the ram housing bore into the through bore.

15. The angle-cut shear ram blowout preventer system of claim 14, wherein the sliding ram track is integral in the ram housing bore.

16. The angle-cut shear ram blowout preventer system of claim 1, further comprising at least one multiple high strength carbide cutting node disposed on the taper.

17. The angle-cut shear ram blowout preventer system of claim 16, wherein the at least one high strength carbide cutting node is comprised of at least one of: a tungsten carbide insert, a synthetic diamond cutting material, a diamond enhanced cutting material, a diamond impregnated metal matrixes, and combinations thereof.

18. The angle-cut shear ram blowout preventer system of claim 1, further comprising a tungsten carbide hardened edge disposed on the taper.

19. The angle-cut shear ram blowout preventer system of claim 1, further comprising two rails positioned substantially parallel to each other to align the angle-cut shear ram.

20. The angle-cut shear ram blowout preventer system of claim 1, further comprising a hollow bore formed in the common rod and a linear displacement transducer disposed in the hollow bore enabling remote control of the common rod.

21. The angle-cut shear ram blowout preventer system of claim 1, further comprising a gas inlet port formed through the pressure containing end cap, and a pyrotechnic accumulator fluidly connected to the gas inlet port and fixedly mounted to the pressure containing end cap.

* * * * *